US005168770A

United States Patent [19]

Ellis

[11] Patent Number: 5,168,770

[45] Date of Patent: Dec. 8, 1992

[54] PIVOTAL HANDLE FOR A WINDOW ACTUATOR

[76] Inventor: Frederick G. Ellis, 80 Burnett Ave., Winnipeg, Manitoba, Canada, R2G 1C1

[21] Appl. No.: 745,395

[22] Filed: Aug. 15, 1991

[51] Int. Cl.[5] ..... G05G 1/04

[52] U.S. Cl. ..... 74/545; 74/547; 49/324; 49/329; 49/339

[58] Field of Search ..... 74/547, 545; 49/324, 49/329, 339; 403/4, 33, 330

[56] References Cited

U.S. PATENT DOCUMENTS 3,091,978 6/1963 Rubinstein ..... 74/545
3,865,500 2/1975 Newell ..... 74/545 X
4,615,236 10/1986 Boots ..... 74/545
4,928,547 5/1990 Huyer ..... 74/545

*Primary Examiner*—Leslie A. Braun
*Assistant Examiner*—William O. Trousdell
*Attorney, Agent, or Firm*—Adrian D. Battison; Murray E. Thrift; Stanley G. Ade

[57] ABSTRACT

A pivotal handle for an actuator of a window includes a triangular shaped cap member with a recess along one side of the triangle shape into which the splined shaft end of the actuator is inserted and clamped. A handle member is pivotal relative to the cap member about a transverse pin positioned directly at the end of the recess. The position of the handle relative to the cap member is controlled by a spring ball mounted within the cap member which cooperates with a straight sided slot on the inner face of the handle member.

12 Claims, 5 Drawing Sheets

PIVOTAL HANDLE FOR A WINDOW ACTUATOR

BACKGROUND OF THE INVENTION

This invention relates to a handle for manually driving rotation of a window actuator of the type including a base for attachment to the frame of a window, a shaft mounted on the base for rotation about an axis longitudinal of the shaft, an actuator lever and means moving the lever in response to rotation of the shaft, the shaft having a splined end portion projecting outwardly from the base for engagement by the handle. The invention is further directed to a window actuator of this type including a pivotal handle.

Window actuators of this type are very well known and manufactured and sold in very large numbers. The actuating lever projects outwardly from the base mounted on the frame of the window so that the lever can move inwardly and outwardly a hinged window section which can pivot about a vertical axis or a horizontal axis as required.

Generally the base of the actuator is positioned on the frame so that the shaft projects outwardly from the frame at an angle of 45° to the attachment plane of the base. Generally, although not necessarily, the attachment plane of the base is horizontal so that the shaft projects upwardly and outwardly from a window frame.

Generally the handle includes a base portion with a recess for engaging over the splined end portion of the shaft, a crank arm and a rotatable element on the end of the crank arm having an axis of rotation parallel to the axis of the shaft. Simply therefore the user can crank the handle around the axis of the shaft to rotate the shaft to drive the lever inwardly and outwardly as required.

In order to provide sufficient torque, the crank arm of the handle is generally three to four inches in length which causes the manually graspable element or knob of the handle to stick out from the window frame by a distance of the order of two inches. This is unsightly and detracts from the overall appearance of the product. Furthermore the handle can cause danger or damage to persons passing by who can trap clothing on the handle with potential damaging results. Furthermore the projecting handle interferes with drapes and blinds suspended at the window providing unsightly bulges or preventing the convenient and proper hanging of the window coverings.

In some cases the occupants or users resolve the problem of the handle simply by removing the handle so that it no longer projects outwardly. However this exposes the unsightly splined end of the shaft which is of course entirely utilitarian in appearance. Furthermore when it is required to operate the window, the handle is generally not available and must be stored at some other location and found and replaced when required.

Up till now there has been no solution to this particular problem and the users therefore either accept the unsightly appearance or simply remove the handle as explained above.

SUMMARY OF THE INVENTION

It is one object of the present invention to provide an improved handle arrangement of the type described above for manually driving rotation of a window actuator, which allows the handle to be retracted when not in use.

According to the invention, therefore, there is provided a handle for manually driving rotation of a window actuator including a base for attachment to a frame of the window, a shaft mounted on the base for rotation about an axis longitudinal of the shaft, an actuator lever and means moving the lever in response to rotation of the shaft, the shaft having a splined end portion projecting outwardly from the base for engagement by the handle, the handle comprising a cap member having a recess therein for engagement over the splined end portion so as to be rotatable with the shaft in driving communication therewith, a handle member mounted on the cap member, the handle member having a base portion defining a recess within which the cap member is received, an elongate crank arm connected to the base portion and extending therefrom to one side of the axis of the shaft, and manually graspable element at an end of the crank arm by which the user can grasp the crank arm for rotation about the axis of the shaft for drivingly rotating the shaft, and pivot mounting means mounting the handle member on the cap member for pivotal movement of the handle member about an axis transverse to the axis of the shaft and transverse to the length of the crank arm.

The handle can therefore simply be moved from a first operating position in which the manual element has an axis parallel to the axis of the shaft for conventional cranking action to a retracted position in which the crank arm is moved inwardly toward the window and toward a plane containing the end of the shaft and at right angles to the shaft.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 1:
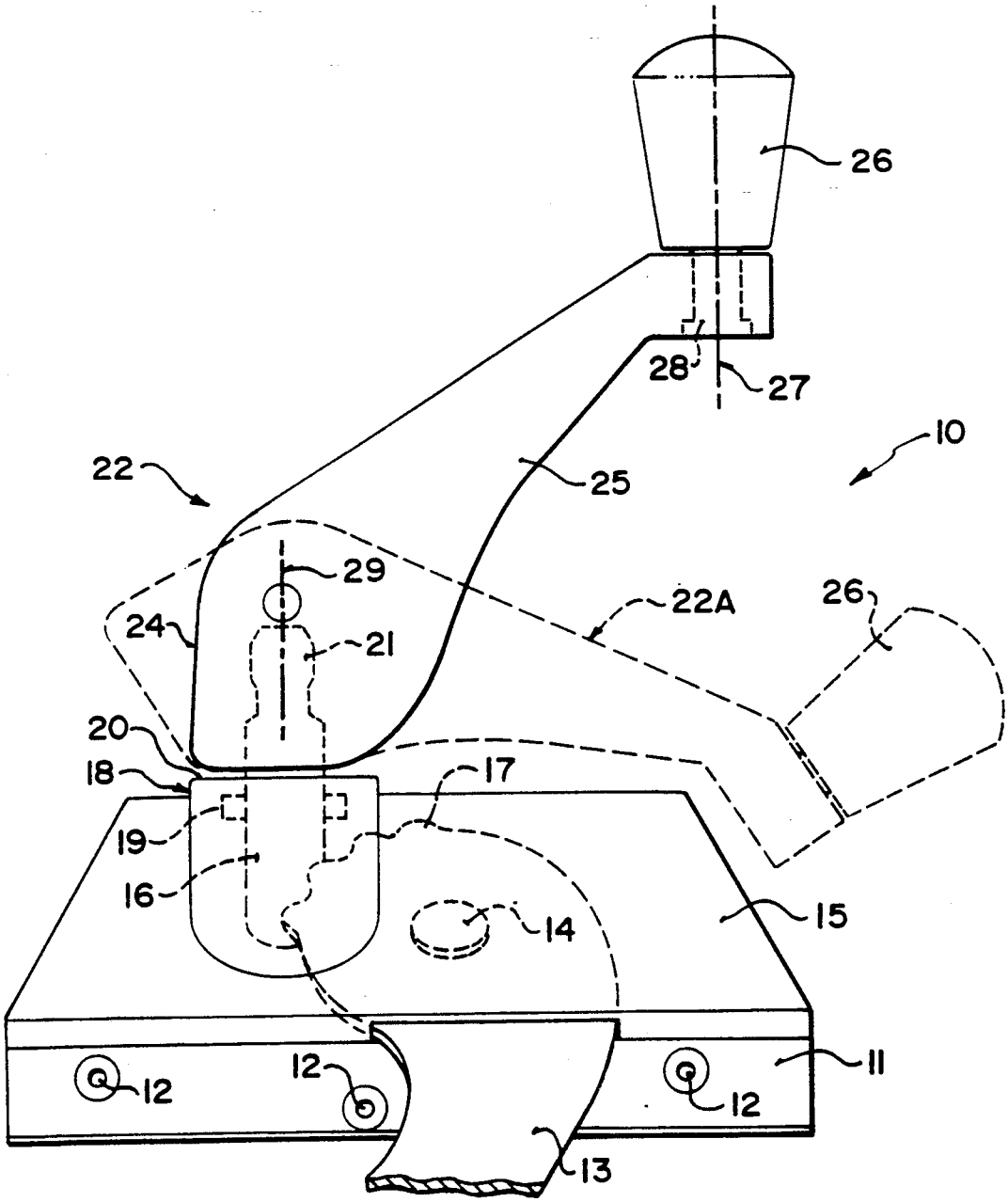
FIG. 1 is a plan view of a window actuator according to the present invention viewing the actuator from a position at right angles to the axis of the shaft and showing the pivotal handle in a first operating position and a second retracted position.

In FIG. 1 is shown a conventional actuator generally indicated at 10 including a base plate 11 including a plurality of screw openings 12 by which the base plate can be fastened to a window frame. On top of the base plate is mounted an actuating mechanism which includes a lever 13 mounted for rotation about a support 14 located between the base plate 11 and an upper housing section 15. Movement of the lever is obtained by rotation of a shaft 16 which carries a gear at a lower end thereof cooperating with gear teeth 17 on an inner end of the lever 13.

The shaft 16 is mounted within a boss 18 extending outwardly from the upper plate 15 at an angle generally of the order of 45° thereto. The boss carries bearings 19 mounting the shaft 16 for rotation about an axis of the shaft. The shaft projects outwardly beyond a flat end face 20 of the boss to form a splined end portion 21 which projects outwardly and forwardly from the actuator for engagement with a handle generally indicated at 22.

The actuator including the splined end portion 21 is strictly of conventional construction and the design illustrated is merely one example and is shown only schematically as the full details will be well known to one skilled in the art.

The present invention is concerned with the construction and operation of the handle 22 which is designed specifically to be pivotal between an operating position shown in full line in FIG. 1 to a retracted position shown in dotted line 22A in FIG. 1.

Figure 2:
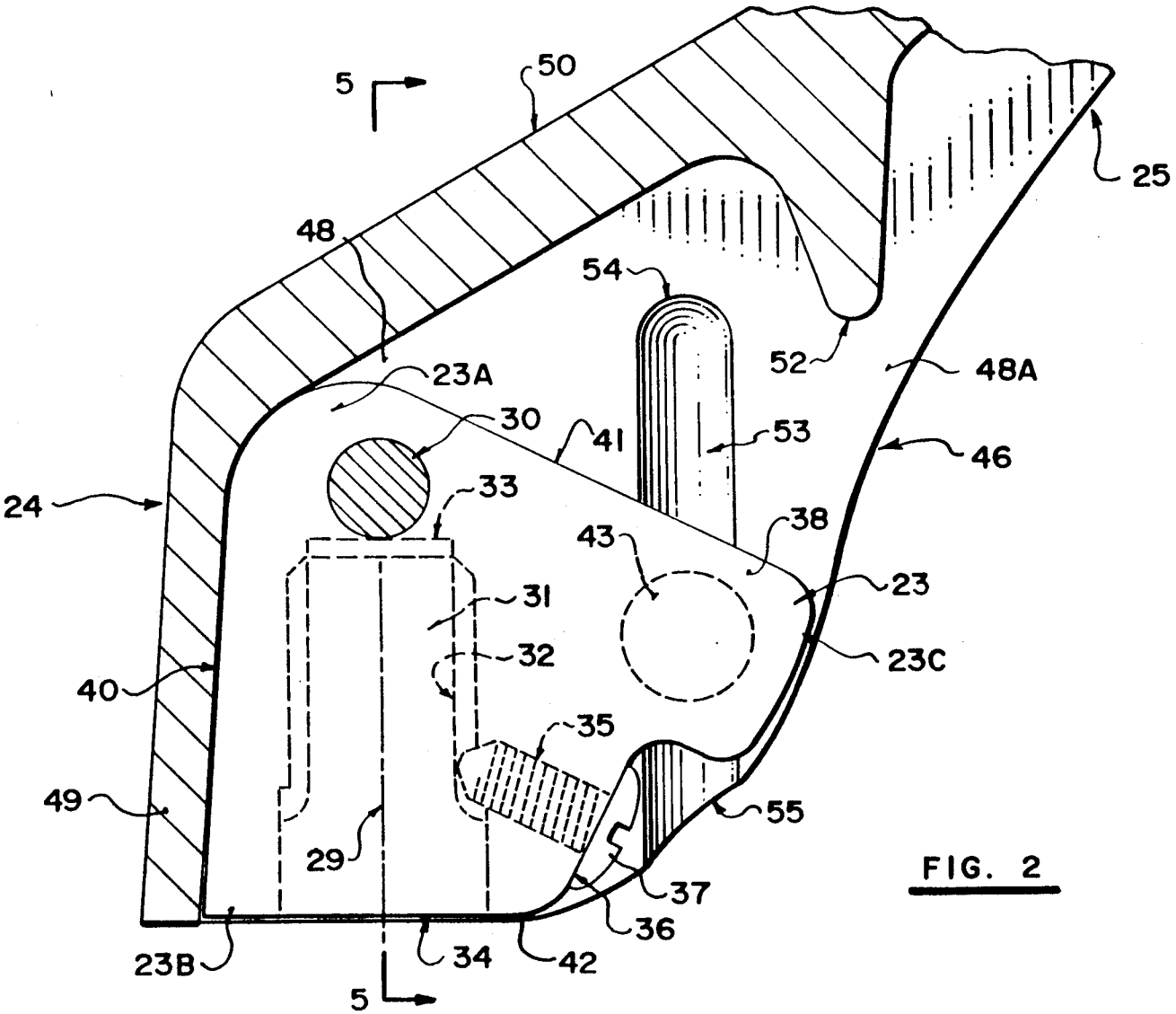
FIG. 2 is a partial cross-sectional view of the handle of FIG. 1 shown in the operating position and taken in the same direction as shown in FIG. 1.

The handle includes generally a cap member shown best in FIG. 2 and indicated at 23. The handle further includes a base portion 24 within which the cap member 23 is received, a crank arm 25 which projects from the base portion outwardly to one side of the shaft and a manually graspable element or knob 26 which is rotatable about an axis 27 on a shaft 28 arranged so that in the operating position shown in full line in FIG. 1 the axis 27 lies parallel to the axis 29 of the shaft 16. In the retracted position indicated at 22A, the manually graspable knob 26 is moved inwardly to a retracted position lying in a plane at right angles to the end of the splined portion of the shaft.

The shape of the base portion of the handle member is shown in more detail in the remaining figures. The cap member 23 is generally triangular shape in side elevation having apexes 23A, 23B and 23C and three sides interconnecting those apexes. Adjacent the apex 23A is provided a pivot pin 30 which extends through the cap member in a direction at right angles to the axis 29 of the shaft and in a direction at right angles to the length of the crank arm 25. Along one side of the apex 23A to the apex 23B is provided a recess 31 for receiving the splined end portion of the shaft. The recess 31 thus has splined interior 32. The recess 31 has a closed end 33 and breaks out on an open face of the cap member as indicated at 34. A bore 35 extends at an angle from the recess 31 to a shoulder 36 recessed within the outer surface of the cap member. The third side of the cap member therefore extends from the apex 23B to the apex 23C and includes a straight section where the opening 34 is provided followed by the shoulder 36 which is recessed into the smoothly curved section extending toward the apex 23C. The bore 35 is threaded so as to receive a set screw 37 which can be screwed into place to grasp the splined end of the shaft when it is inserted into the cap member and particularly the recess 31.

Figure 4:
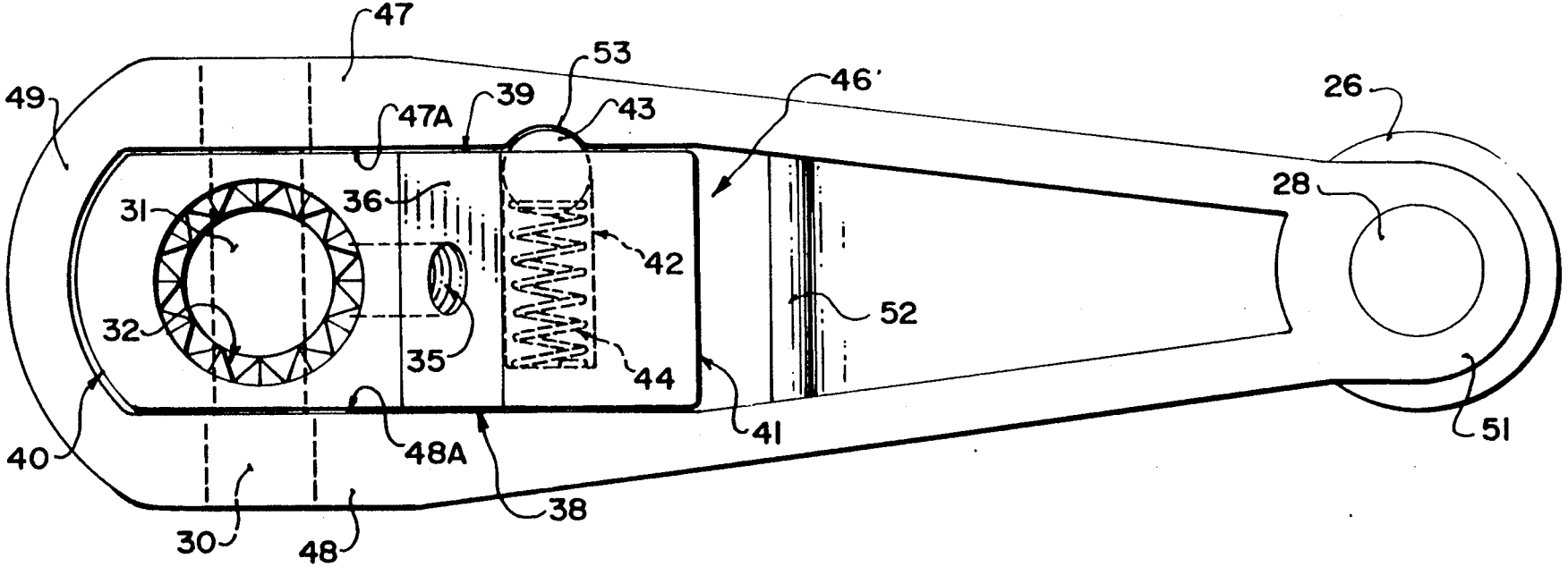
FIG. 4 is an underside view of the handle when removed from the actuator.
Figure 5:
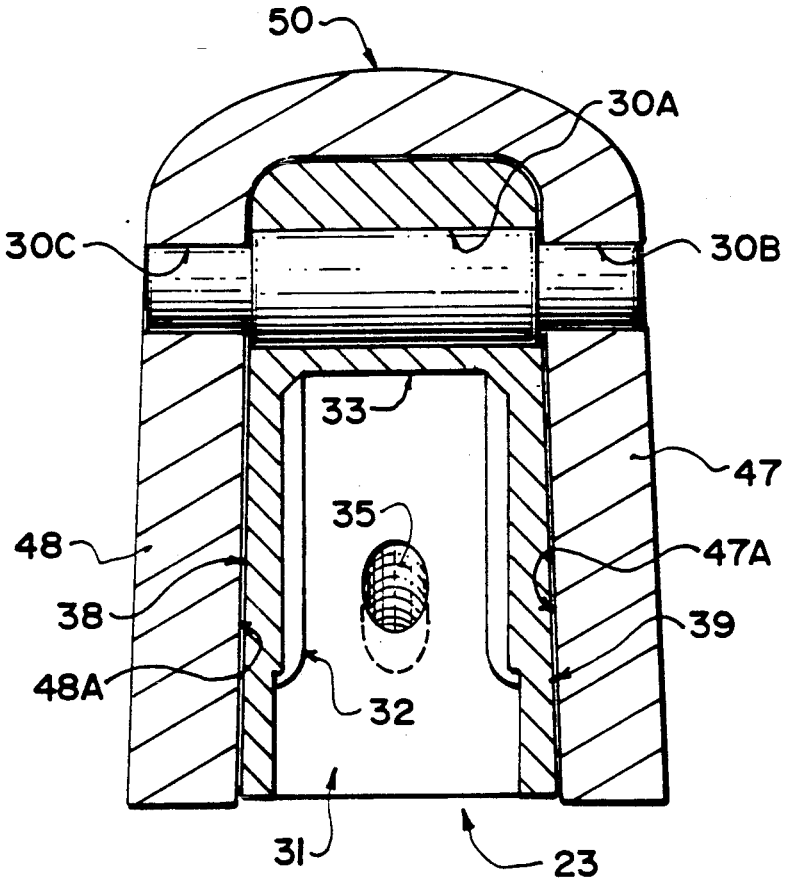
FIG. 5 is a cross-sectional view along the lines 5—5 of FIG. 2.

The cap member has a first flat side 38 and a second flat side 39 as best shown in FIG. 4 both of which sides are mutually parallel and lie in planes at right angles to the axis of the pin 30. The faces 38 and 39 terminate at edges of the cap member thus forming side faces 40, 41 and 42 of the cap member. The side face 40 is curved so as to follow around the recess so that the thickness of the material of the cap member on the side of the recess adjacent the side 40 is maintained substantially constant and is maintained in substantially a minimum amount.

In the face 39 of the cap member is provided a bore 42 which receives a ball 43 and a spring 44 acting as a resilient member so as to project outwardly from the face 39 of the cap member.

Figure 3:
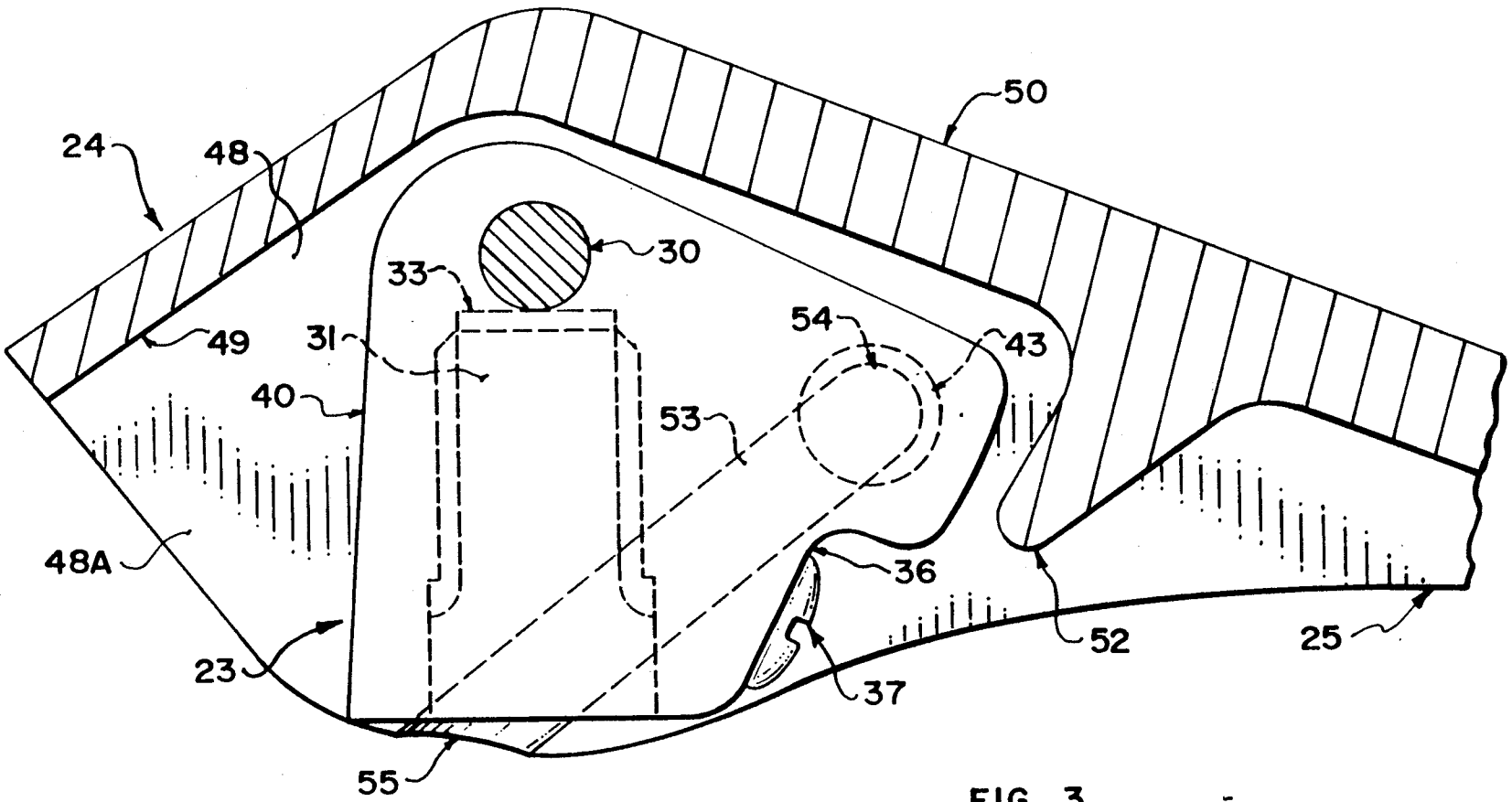
FIG. 3 is a cross-sectional view similar to that of FIG. 2 showing the handle in the retracted position.

The handle member includes the base portion as shown in FIGS. 2 and 3 which forms a recess 46 on the underside which is surrounded as best shown in FIG. 4 by sidewalls 47 and 48 and an end wall 49. These walls are formed into a generally U-shape in cross-section with inside surfaces of the walls defining the recess 46 for receiving the cap member. The wall 47 has an inside surface 47A which is parallel to an inside surface 48A of the wall 48 and spaced by the width of the cap member so that the face 47A guides the side 39 of the cap member and the face 48A guides the sides 38 of the cap member in pivotal movement of the handle relative to the cap member about the pin 30. The thickness of the front wall 49 is maintained at a minimum thickness of material for providing the necessary strength and this ensures that the contour of the handle in the operating position closely follows that of the boss of the actuator thus forming attractive lines and a professional appearance.

The handle further includes an upper wall 50 which defines an upper part of the recess and extends therefrom contiguously with the crank arm toward the knob 26. The whole of the underside of the handle as best shown in FIG. 4 is open from the recess through to a cylindrical receptacle 51 for the shaft 28. To provide a stiffening effect for the sides, however, there is provided a depending portion 52 which extends downwardly from the wall 50 and connects to the sides 47 and 48. The sides converge from the widest part at the base of the handle inwardly along the length of the crank arm to the receptacle 51.

On the inside face 47A of the wall 47 is provided a slot shaped indentation 53 which extends parallel to the axis 29 from a position adjacent the upper wall 50 at which it defines a semi circular end 54 to the bottom edge of the wall 47 where it breaks out as indicated at 55. The indentation in the form of a slot does not extend through the thickness of the wall but simply defines a shallow channel of curved cross-section as shown in FIG. 4 for receiving the periphery of the ball 43. The indentation or channel 53 is formed as a straight slot with straight sides so that it can be cast in place within the handle member with the mold forming the interior of the handle member being shaped so that it can be pulled directly out of the interior of the cast handle in the direction of the axis 29 and thus in a direction of the channel 53. The ball 43 however only aligns with the channel 53 at two locations as shown in FIGS. 2 and 3 respectively. In the remainder of the pivotal movement of the handle member relative to the cap member, the ball is depressed into the bore 42 against the bias of the spring and is only allowed to snap out of position into the channel at the two spaced locations. This acts therefore to locate the handle in the operational and retracted positions respectively.

If it is required to provide increased movement of the handle from the operational position to the retracted position, this can be accommodated by providing two such slots or channels 53 which are parallel to the axis 29 but one is offset away from the pivot axis of the pin 30. In the same way as described above, therefore, the mold can be pulled out in the axial direction along the slot and the ball cooperates with the slot only at the two spaced locations.

The pin 30 extends through a bore 30A in the cap member 23 and into receiving openings 30B and 30C in the walls 47 and 48 respectively of the handle member. The pin has suitable shoulders to prevent it escaping simply by falling through one end to the other end so that it maintains as a pivot pin holding the cap member permanently to the handle member and allowing the pivotal action of the handle.

The positioning of the pin 30 directly at the end of the recess with the axis of the pin 30 lying on the axis 29 ensures the most compact construction and allows the height of the handle to be minimized in the retracted position. The parallel sides of the cap member which cooperate with the surfaces of the handle member ensures that the forces from the handle to the cap member are communicated through the relatively wide surfaces rather than simply through the pin itself which otherwise would lead to significant wear. The positioning of the recess very closely adjacent the front surface of the cap member and the use of minimum thickness of the wall 49 ensures a very neat compact construction. The positioning of the set screw as shown so that it projects away from the recess in the same direction as the handle ensures that the set screw is mounted within a significant thickness of the cap member. In addition the set screw is held at a position away from sight in the retracted position so that it does not interfere with the attractive appearance of the product. However the set screw is still accessible to allow the cap member to be clamped and unclamped from its position on the splined end of the shaft.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A window actuator comprising a base for attachment to a frame of the window, a shaft mounted on the base for rotation about an axis longitudinal of the shaft, an actuator lever, means moving the lever in response to rotation of the shaft, the shaft having a splined end portion projecting outwardly from the base, and a handle comprising a cap member having a cap recess therein having an open mouth for engagement over the shaft and a peripheral surface for engaging the splined end portion such that a longitudinal axis of the cap recess is coincident with an axis of the shaft and the cap is rotatable with the shaft in driving communication therewith, a handle member mounted on the cap member, the handle member having a base portion defining a handle recess within which the cap member is received, an elongate crank arm connected to the base portion and extending therefrom to one side of the axis of the recess, and a manually graspable knob rotatable relative to the crank arm about a crank axis at an end of the crank arm by which the user can grasp the crank arm for rotation about the axis of the recess for drivingly rotating the shaft, and a pivot mounting pin mounting the handle member on the cap member for pivotal movement of the handle member about an axis transverse to the axis of the shaft and transverse to the length of the crank arm, said cap member having parallel sides thereof each lying in a plane substantially at right angles to the pivot axis of the handle member, said handle recess having parallel faces thereof each lying in a plane substantially at right angles to the pivot axis thereof so that each face of the handle member lies substantially in contact with a respective one of the sides of the cap member for communication of twisting forces from the handle member to the cap member, the handle member being movable from a first extreme position, in which the crank arm extends in a direction which is inclined to the axis of the cap recess so as to extend in a direction longitudinally of the axis of the cap recess and opposed to the open mouth of the cap recess and away from one side of the cap recess and in which the crank axis of the manually graspable knob is substantially parallel to the axis of the cap recess, to a second extreme position in which the crank arm and the manually graspable knob are retracted to a position substantially at right angles to the axis of the cap recess, said parallel sides of the cap member remaining substantially wholly and continually in contact with the parallel faces of the handle recess at said extreme positions and during said movement, and locating means for preventing movement beyond said first and second extreme positions.

2. The actuator according to claim 1 wherein said locating means comprises a resilient element mounted on the cap member and projecting outwardly from one side thereof and means defining a first and a second indentation portion on a face of the recess of the handle member lying closely adjacent the cap member, the indentation portion being arranged relative to the pivot axis such that the resilient element engages into a respective one of said indentation portions at said first and second positions respectively.

3. The actuator according to claim 2 wherein the first and second indentation positions are defined by groove means having straight sides extending from the indentation portion to an edge of the handle recess.

4. The actuator according to claim 1 wherein the cap member includes a threaded bore therein extending from the recess to an outer face thereof and a set screw threadedly mounted in the bore for clamping the splined end portion of the shaft, the bore extending from the recess in a direction such that an axis of the bore lies in a common plane with the crank arm and extending from the recess to the same side of the shaft as the crank arm.

5. A window actuator comprising a base for attachment to a frame of the window, a shaft mounted on the base for rotation about an axis longitudinal of the shaft, an actuator lever, means moving the lever in response to rotation of the shaft, the shaft having a splined end portion projecting outwardly from the base, and a handle comprising a cap member having a cap recess therein having an open mouth for engagement over the shaft and a peripheral surface for engaging the splined end portion such that a longitudinal axis of the cap recess is coincident with an axis of the shaft and the cap is rotatable with the shaft in driving communication therewith, a handle member mounted on the cap member, the handle member having a base portion defining a handle recess within which the cap member is received, an elongate crank arm connected to the base portion and extending therefrom to one side of the axis of the recess, and a manually graspable knob rotatable relative to the crank arm about a crank axis at an end of the crank arm by which the user can grasp the crank arm for rotation about the axis of the recess for drivingly rotating the shaft, and a pivot mounting pin mounting the handle member on the cap member for pivotal movement of the handle member about an axis transverse to the axis of the shaft and transverse to the length of the crank arm, amid cap member having parallel sides thereof each lying in a plane substantially at right angles to the pivot axis of the handle member, said handle recess having parallel faces thereof each lying in a plane substantially at right angles to the pivot axis thereof so that each face of the handle member lies substantially in contact with a respective one of the sides of the cap member for communication of twisting forces from the handle member to the cap member, said pivot mounting pin being mounted immediately at an end of the cap recess at a position such that the axis of the cap recess intersects the pin, the handle member being movable from a first extreme position, in which the crank arm extends in a direction which is inclined, to the axis of the cap recess so as to extend in a direction longitudinally of the axis of the cap recess and opposed to the open mouth of the cap recess and away from one side of the cap recess and in which the crank axis of the manually graspable know is substantially parallel to the axis of the cap recess, to a second extreme position in which the crank arm and the manually graspable knob are retracted to a position substantially at right angles to the axis of the cap recess, and locating means for inhibiting movement beyond said first and second extreme positions.

6. The actuator according to claim 5 wherein the parallel faces of the handle recess extend in an angular direction around said pivot mounting pin to a greater length than the length of the parallel sides of the cap member in an angular direction around said pivot mounting pin such that the parallel sides of the cap member remains substantially wholly and continually in contact with the parallel faces of the handle recess at said extreme positions and during said movement between said extreme positions.

7. The actuator according to claim 6 wherein each of the parallel sides of the cap member is substantially triangular in shape with said pivot mounting pin arranged adjacent one apex, said triangular shape subtending an acute angle.

8. The actuator according to claim 7 wherein the handle recess has two end surfaces each forming one end of a channel defined between said parallel faces of the handle recess, the two end surfaces converging to one channel apex adjacent said one apex of said cap member, the angle subtended between said end surfaces being greater than said acute angle by an angle substantially equal to an angle of movement of the handle member between said first and second extreme positions.

9. The actuator according to claim 5 wherein said locating means comprises a resilient element mounted on the cap member and projecting outwardly from one side thereof and means defining a first and a second indentation portion on a face of the recess of the handle member lying closely adjacent the cap member, the indentation portion being arranged relative to the pivot axis such that the resilient element engages into a respective one of said indentation portions at said first and second positions respectively.

10. The actuator according to claim 9, wherein the first and second indentation portions are defined by groove means having straight sides extending from the indentation portions to an edge of the handle.

11. The actuator according to claim 5, wherein the cap member includes a threaded bore therein extending from the recess to an outer face thereof and a set screw threadly mounted in the bore for clamping the splined end portion of the shaft, the bore extending from the recess in a direction such that an axis of the bore lies in a common plane with the crank arm and extending from the recess to the same side of the shaft as the crank arm.

12. A window actuator comprising a base for attachment to a frame of the window, a shaft mounted on the base for rotation about an axis longitudinal of the shaft, an actuator lever, means moving the lever in response to rotation of the shaft, the shaft having a splined end portion projecting outwardly from the base, and a handle comprising a cap member having a cap recess therein having an open mouth for engagement over the shaft and a peripheral surface for engaging the splined end portion such that a longitudinal axis of the cap recess is coincident with an axis of the shaft and the cap is rotatable with the shaft in driving communication therewith, a handle member mounted on the cap member, the handle member having a base portion defining a handle recess within which the cap member is received, an elongate crank arm connected to the base portion and extending therefrom to one side of the axis of the recess, and a manually graspable knob rotatable relative to the crank arm about a crank axis at an end of the crank arm by which the user can grasp the crank arm for rotation about the axis of the recess for drivingly rotating the shaft, and a pivot mounting pin mounting the handle member on the cap member for pivotal movement of the handle member about an axis transverse to the axis of the shaft and transverse to the length of the crank arm, said cap member having parallel sides thereof each lying in a plane substantially at right angles to the pivot axis of the handle member, said handle recess in the handle member the handle member being movable from a first extreme position, in which the crank arm extended in a direction which is inclined to the axis of the recess so as to extend in a direction longitudinally of the axis of the recess and opposed to the open mouth of the recess and away from one side of the recess and in which the crank axis of the manually graspable knob is substantially parallel to the axis of the recess, to a second extreme position in which the crank arm and the manually graspable knob are retracted to a position substantially at right angles to the axis of the recess, and locating means for preventing movement beyond said first and second extreme positions.

* * * * *